US008148660B2

(12) United States Patent
Seeger et al.

(10) Patent No.: US 8,148,660 B2
(45) Date of Patent: Apr. 3, 2012

(54) GAS-INSULATED HIGH-VOLTAGE CIRCUIT BREAKER WITH A RELIEF DUCT WHICH IS CONTROLLED BY AN OVERFLOW VALVE

(75) Inventors: Martin Seeger, Ammerswil (CH); Lutz Niemeyer, Birr (CH); Arthouros Iordanidis, Baden (CH); Christian Franck, Zurich (CH)

(73) Assignee: ABB Research Ltd, Zurich (CH)

( * ) Notice: Subject to any disclaimer, the term of this patent is extended or adjusted under 35 U.S.C. 154(b) by 170 days.

(21) Appl. No.: 12/761,178

(22) Filed: Apr. 15, 2010

(65) Prior Publication Data

US 2010/0219161 A1 Sep. 2, 2010

Related U.S. Application Data

(63) Continuation of application No. PCT/EP2007/061005, filed on Oct. 16, 2007.

(51) Int. Cl.
*H01H 33/88* (2006.01)

(52) U.S. Cl. ..... 218/51; 218/43; 218/59

(58) Field of Classification Search ..... 218/43, 218/51–68

See application file for complete search history.

(56) References Cited

U.S. PATENT DOCUMENTS 4,475,018 A * 10/1984 Arimoto et al. ..... 218/56
4,486,632 A * 12/1984 Niemeyer et al. ..... 218/57
4,774,388 A * 9/1988 Thuries et al. ..... 218/59
5,808,257 A * 9/1998 Thuries ..... 218/60
6,207,918 B1 3/2001 Lorenz et al.

FOREIGN PATENT DOCUMENTS

DE 44 12 249 A1 10/1995
DE 196 29 475 A1 1/1998
DE 198 59 764 A1 6/2000

OTHER PUBLICATIONS

Notification of Transmittal of Translation of the International Preliminary Report on Patentability (Forms PCT/IB/338 and PCT/IPEA/338) issued in corresponding International Application No. PCT/EP2007/061005 dated Jul. 29, 2010.
International Search Report (PCT/ISA/210) for PCT/EP2007/061005 dated Sep. 3, 2008.

* cited by examiner

*Primary Examiner* — Renee Luebke
*Assistant Examiner* — Marina Fishman
(74) *Attorney, Agent, or Firm* — Buchanan Ingersoll & Rooney PC

(57) ABSTRACT

A high-voltage circuit breaker includes two arcing contacts, which are capable of moving relative to one another along an axis, an insulating nozzle, a heating volume for accommodating quenching gas, a heating channel, and an overpressure valve. The pressure of the quenching gas is based on the energy of a switching arc, which is formed when the breaker opens and generates arcing gas, and the heating channel opens out, with axial alignment, into the heating volume. The heating channel connects an arc zone, and the overpressure valve limits the pressure of the quenching gas by opening a relief duct, which opens out into an expansion space. In high-current switching, the pressure of the arcing gases in the arc zone is limited, and the quality of the quenching gas stored in the heating volume is improved, due to the relief duct having an outflow section extending in the radial direction.

22 Claims, 5 Drawing Sheets

GAS-INSULATED HIGH-VOLTAGE CIRCUIT BREAKER WITH A RELIEF DUCT WHICH IS CONTROLLED BY AN OVERFLOW VALVE

RELATED APPLICATIONS

This application claims priority as a continuation application under 35 U.S.C. §120 to PCT/EP2007/061005 filed as an International Application on Oct. 16, 2007 designating the U.S., the entire content of which is hereby incorporated by reference in its entirety.

FIELD

The present disclosure relates to a gas-insulated high-voltage circuit breaker.

BACKGROUND INFORMATION

Gas-insulating high-voltage breakers are used in an electrical network carrying high voltages for connecting and disconnecting current having an intensity which ranges from very low inductive and capacitive current through normal load current up to medium and high short-circuit current. It is generally possible with such breakers to interrupt short-circuit currents in the region of 50 kA or above in a voltage range of up to several hundred kV.

A gas-insulated high-voltage circuit breaker of the type mentioned above contains two arcing contacts, which are capable of moving relative to one another along an axis, an insulating nozzle, a heating volume for accommodating quenching gas, a heating channel, and an overpressure valve. With this breaker, the pressure of the quenching gas is determined by the energy of a switching arc which is formed when the breaker opens and generates arcing gas, and the heating channel opens out, with axial alignment, into the heating volume. At the same time, the heating channel connects an arc zone, which is delimited axially from the two arcing contacts and radially with respect to the insulating nozzle, to the heating volume, and the overpressure valve limits the pressure of the quenching gas by opening a relief duct, which opens out into an expansion space.

In order to quench the switching arc, an insulating gas with good arc-quenching properties is used. The insulating gas is compressed during the disconnection operation and subsequently blows the arc, by acting as a quenching gas, until the arc is extinguished in the zero crossing of the current to be interrupted. A compression device is used as the compression means in this arrangement. The compression device is actuated by the breaker drive and therefore requires drive energy and/or the switching arc itself, whose energy, which is released in the high-current phase of the current to be interrupted, is used for storing hot arcing gases under pressure in the heating volume (the so-called self-blowing principle).

Breakers functioning in accordance with the self-blowing principle do not consume any drive energy and also advantageously guide eroded material of an insulating nozzle into the heating volume. The pressure as well as the temperature in the heating volume increase nonlinearly and virtually quadratically with the current intensity of the arc. In general, a heating flow triggered by the switching arc in the arc zone and the size of the heating volume are matched in optimum fashion to low-level and mid-level currents, since, when matching two high-level currents, the heating flow would otherwise be much too low for low currents and it would not be possible for a sufficiently high quenching gas pressure for successful arc blowing to be built up in the heating volume. When switching high currents, arcing gas with a high pressure and a high temperature can therefore form in the arc zone, whereby the arcing gas subjecting both the insulating nozzle and the heating volume to severe mechanical and thermal loads and at the same time has unfavorable quenching gas properties as a result of the high temperature.

A breaker of the type mentioned at the outset is described in DE 44 12 249 A1. This breaker has a heating volume, which can be expanded elastically by the pressure of the quenching gas, and has a delimiting wall which can be adjusted counter to a restoring force. In the event of the occurrence of high-current arcs, the heating volume is enlarged by movement of the delimiting wall, which makes it possible for more hot quenching gas to be stored in the heating volume. In order to limit the quenching gas pressure resulting in the heating volume, an overpressure valve is provided for very high current intensities. The overpressure valve is arranged in a radially aligned wall of the heating volume and guides the quenching gas above a limit value of the quenching gas pressure via an axially extended relief duct into an expansion space.

A breaker described in DE 198 59 764 A1 has storage means, which serve the purpose of buffer-storing heated gas which is formed during interruption of the current by a switching arc burning in an arc zone in the high-current phase of an alternating current to be interrupted. When the current approaches a zero crossing, the heating effect of the switching arc abates and the heated gas first flows out of a small control volume of the storage means via a channel and a gap into the arc zone. Since the control volume is substantially smaller than a quenching volume of the storage means, the control volume empties much quicker than the quenching volume. As a result, the gas pressure in the control volume drops severely, and a wall which separates the two volumes from one another is moved, which causes a quenching opening to be released and the channel to be sealed. Comparatively cool gas from the quenching volume is then guided through the quenching opening and the gap into the arc zone, in which the cool gas blows the switching arc and expands into an expansion space via a constriction of an insulating nozzle and a constriction of a hollow contact piece.

SUMMARY

An exemplary embodiment of the present disclosure provides a gas-insulated high-voltage circuit breaker. The exemplary breaker comprises two arcing contacts, which are configured to move relative to one another along an axis, and an insulating nozzle. The exemplary breaker also comprises a switching arc configured to be formed when the breaker opens and generates an arcing gas. In addition, the exemplary breaker comprises a heating volume for accommodating a quenching gas, whose pressure is based on the energy of the switching arc formed when the breaker opens and generates the arcing gas. The exemplary breaker also comprises an arc zone, which is delimited from the two arcing contacts axially and radially with respect to the insulating nozzle, and an expansion space, into which the quenching gas expands during disconnection of the breaker after blowing of the switching arc. Furthermore, the exemplary breaker comprises a relief duct which opens out into the expansion space. The exemplary breaker also comprises a heating channel, which connects the arc zone to the heating volume and opens out, with axial alignment, into the heating volume, and which connects the expansion space to the relief duct. The exemplary breaker also comprises an overpressure valve configured to limit the pressure of the quenching gas by opening the relief duct. The relief duct can have an outflow section which extends in the radial direction.

BRIEF DESCRIPTION OF THE DRAWINGS

Exemplary embodiments of the disclosure will be explained in more detail below with reference to drawings, in which FIGS. 2, 5, 8 and 12 show one of the exemplary embodiments of the breaker shown in FIGS. 1, 4, 7 and 11, respectively in order, in the case of overpressure limitation during disconnection, and FIGS. 3 and 6 show a plan view of a section guided along III-III and VI-VI, respectively, through the exemplary breaker shown in FIGS. 1 and 4, respectively.

DETAILED DESCRIPTION

Figure 1:
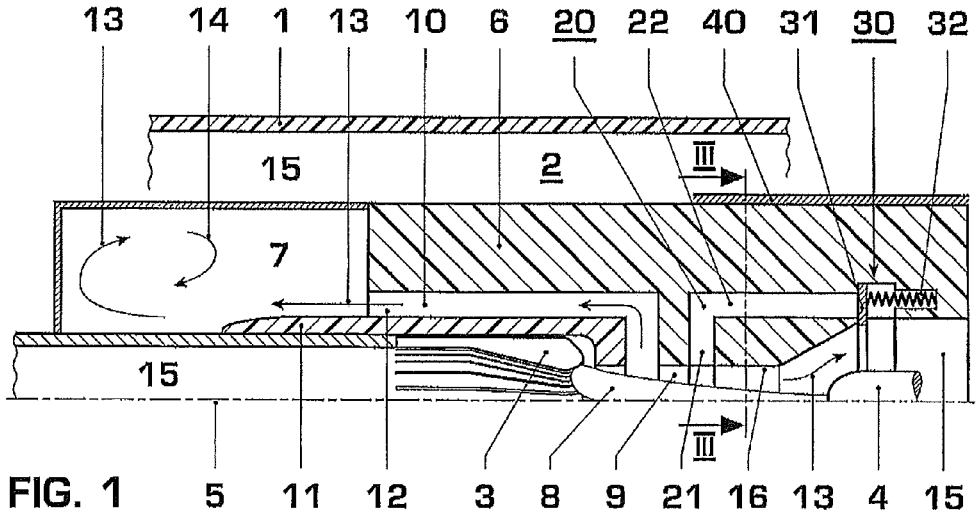
FIGS. 1 to 13 show seven different exemplary embodiments of a high-voltage circuit breaker according to the present disclosure, in which FIGS. 1, 4, 7, 9, 10, 11, and 13 each show a plan view of an axially guided section through a part, which is positioned above an axis, of one of seven exemplary embodiments of the breaker during disconnection.

Exemplary embodiments of the present disclosure provide a high-voltage circuit breaker in which, when switching high currents, the pressure of the arcing gases in the arc zone is limited and, at the same time, the quality of the quenching gas stored in the heating volume is improved.

According to an exemplary embodiment, a relief duct of the breaker is controlled by an overpressure valve and has an outflow section which extends in the radial direction. When switching high currents, therefore, hot arcing gas can be guided radially out of the arc zone or the heating volume once the overpressure valve has responded. Firstly, the insulating nozzle and the heating volume are thus protected from excessive thermal and mechanical loading by virtue of the hot arcing gas. Secondly, however, a quenching gas of good quality is also therefore achieved in the heating volume. This good quenching gas quality is ensured by virtue of the fact that, by limiting the pressure of the arcing gas in the arc zone, excessively hot and excessively highly compressed arcing gas is kept away from the heating volume. If the limiting of the gas pressure first takes place in the heating volume, the hot arcing gas which enters axially into the heating volume is removed radially from the heating volume. A circulation of the quenching gas in the heating volume which is brought about by the hot arcing gas which is flowing in axially, is thus largely suppressed and, as a result, the temperature of the quenching gas provided in the heating volume is kept low. Furthermore, the length of the insulating nozzle in the axial direction can also be kept small since the maximum pressure of the arcing gas in the arc zone is now limited.

If the outflow section branches off from a cylindrical and axially extended constriction of the insulating nozzle, the pressure of the arcing gas in the arc zone and therefore in the heating volume is limited particularly effectively in the event of the occurrence of very powerful switching arcs. That is to say, if the overpressure valve responds, the switching arc generally extends over the entire length of the nozzle constriction. Two stagnation points in an arcing gas flow then form to the right and left of the outflow section in the nozzle constriction, and the arcing gas flow escapes with a partial flow positioned between the two stagnation points through the outflow section of the open relief duct into the expansion space. By virtue of the formation of the two stagnation points, the gas pressure in the insulating nozzle is reduced virtually without any delay, and thus, the insulating nozzle and the heating volume are protected extremely rapidly from impermissibly high loading as a result of hot arcing gas. A reduction in the gas pressure which is generally sufficient is achieved if the flow cross section of the outflow section is equal to or greater than the flow cross section of the constriction. Advantageously, the outflow section is arranged approximately in the center of the constriction, since in this case the reduction in the gas pressure in the arc zone is particularly great after the response of the overpressure valve and is virtually 50%.

In an exemplary embodiment which is particularly simple to implement, the outflow section is formed as part of the heating channel. In this embodiment and in the embodiment described above with the outflow section formed into the constriction of the insulating nozzle, at least one axially extended section of the relief duct advantageously adjoins the outflow section, and an annular valve body of the overpressure valve is mounted moveably in the axially extended duct section. The arcing gas which is removed from the arc zone after the response of the overpressure valve then passes into the expansion space at a dielectrically uncritical point.

A favorable outflow response of hot arcing gas with a high pressure from the arc zone is achieved with an exemplary embodiment of the breaker in accordance with the present disclosure, in which the outflow section has a constant flow cross section. In this embodiment, the valve member of the overpressure valve, in a manner which is simple in terms of manufacturing, can be in the form of a spring-loaded plate, for example, which closes off the axially extended section of the relief duct below the response pressure.

A good outflow response is also provided by an exemplary embodiment of the breaker in accordance with the present disclosure in which the outflow section is variable as a function of the pressure of the arcing gas formed in the arc zone above a limit value of the arcing gas pressure. The outflow cross section is then in general part of the overpressure valve and can be integrated together therewith easily in the insulating nozzle, in particular when a movable valve body of the overpressure valve is part of the insulating nozzle. If an axially extended section of the nozzle constriction forms this valve body, an outflow section is achieved which is arranged in the insulating nozzle. If, on the other hand, the nozzle constriction forms the valve body, an outflow section is achieved which is in the form of an inlet of the heating channel, which is connected to the arc zone. Advantageously, at least two radially outwardly extended sliding bodies are fitted on the valve body, which forms, completely or partially, the constriction of the insulating nozzle said sliding bodies being mounted in each case in one of two axially aligned guide channels, which are arranged so as to be offset with respect to one another in the circumferential direction, and a restoring force can be applied to the sliding bodies.

In order to achieve a high mechanical strength of the insulating nozzle, in general the relief duct has a plurality of axially extended duct sections, which are arranged so as to be distributed uniformly in the circumferential direction about the axis.

In order to homogenize the electrical field acting on the insulating nozzle, the insulating nozzle bears an electrically conductive shield on an axially extended section of the outer side of the insulating nozzle. Metallic component parts which may be used in the overpressure valve and hot arcing gases which may still be present in the relief duct or in other cavities in the insulating nozzle then do not impair the dielectric strength of the insulating nozzle.

The pressure of the arcing gas in the insulating nozzle can also be limited by virtue of the fact that the outflow section contains an opening, which is formed into a tubular contact carrier of an arcing contact, which is rigidly connected to the insulating nozzle, and is sealed by a movable valve body of the overpressure valve, where the valve body can respond to a pressure difference, below a limit value of the quenching gas pressure.

If the opening is arranged at the mouth of the heating channel into the heating volume and, when the overpressure valve is open, connects the heating volume to the expansion space, a jet of hot arcing gas which emerges predominantly axially from the heating channel is deflected at the opening and is guided in the radial direction through the opening, which acts as outflow section of the relief duct, into that part of the expansion space which is radially delimited by the tubular contact carrier.

Advantageously, the valve body is in the form of an axially aligned sleeve, and it is possible for the pressure difference between the heating channel and the heating volume or between the heating volume and the expansion space or a compression space to be applied to the valve body. A low pressure difference is then sufficient for axially moving the sleeve and for driving the overpressure valve in this way with a low force and with a short response time, as a result of which the ingress of hot arcing gas into the heating volume is also prevented for a short period of time once the response pressure has been reached.

A pressure difference which is sufficiently high for safe driving of the overpressure valve is then provided if the valve body is in the form of a radially movable part, and it is possible for the pressure difference between the arc zone and the heating volume, between the heating volume and the expansion space or between the arc zone and the expansion space to be applied to said valve body.

Pressure relief of the arc zone and therefore also of the heating volume is also achieved by virtue of the fact that the relief duct is guided from the arc zone through an axially extended section of the relief duct, where the extended section can be delimited by an auxiliary nozzle and the arcing contact, and the outflow section in the form of an opening in the contact carrier into the expansion space, and the fact that the valve body is in the form of an axially aligned sleeve, and it is possible for the pressure difference between the axially extended duct section of the relief duct and the heating volume, a compression space or the expansion space to be applied to the valve body.

Identical reference symbols relate to functionally identical parts in all of the drawings. Most of these parts are provided with a reference symbol in FIG. 1. In the subsequent FIGS. 2 to 13, the reference symbols have been partially omitted. The seven exemplary embodiments of the high-voltage circuit breaker according to the present disclosure as illustrated in the drawings each contain a quenching chamber housing 1, which is filled with a compressed insulating gas, such as, for example, sulfur hexafluoride, nitrogen, oxygen or carbon dioxide, or mixtures of these gases with one another, for example air. The breaker also includes a contact arrangement 2, which is accommodated in the quenching chamber housing 1. Of the contact arrangement 2 illustrated during an interruption operation, two arcing contacts 3, 4 are illustrated, of which the arcing contact 3 in the form of a nozzle tube is arranged such that the arcing contact 3 can move along an axis 5 and the arcing contact 4 is held fixedly in the housing 1. The arcing contact 4 does not necessarily need to be fixed, but it can also be designed to be movable. The two arcing contacts 3, 4 are surrounded coaxially by an insulating nozzle 6 and a heating volume 7 for storing quenching gas. The heating volume 7 can be in the form of a type of torus with a rectangular cross section in the circumferential direction. In the case of a breaker which is intended for rated voltages from 200 to 300 kV, for example, and for a rated short-circuit disconnection current from 50 to 70 kA, for example, the heating volume 7 can generally accommodate approximately 1 to 2 liters of pressurized quenching gas, for example.

In the connection position of the chamber, the left-hand end of the arcing contact 4 is inserted in current conducting fashion into the right-hand end of the tubular arcing contact 3. During disconnection, the two arcing contacts 3, 4 are separated from one another and form an arc 8 with roots at the two ends of the arcing contacts 3, 4, where the arc 8 burns in an arc zone 9. The arc zone 9 is delimited axially from the two arcing contacts 3, 4 and radially from the insulating nozzle 6 and an auxiliary insulating nozzle 11. The arc zone 9 communicates with the heating volume 7 via a heating channel 10. The heating channel 10 is guided partially axially between the insulating nozzle 6 and the auxiliary insulating nozzle 11, and opens out into the heating volume 7 at an opening 12.

In a half-cycle of the current to be interrupted, the pressure in the arc zone 9 is generally greater than in the heating volume 7. The heating channel 10 then guides an arcing gas flow 13, which is formed by the energy of the arc 8, to enter into the heating volume 7 via the opening 12. If the heating effect of the arc 8 abates as the zero crossing of the current is approached, a flow reversal takes place. Quenching gas 14 stored in the heating volume 7 flows through the opening 12 into the heating channel 7, is guided to the arc zone 9 and there blows the arc 8 at least until the arc 8 has been quenched at the current zero crossing. After blowing, the quenching gas expands into an expansion space 15 delimited by the container 1.

The strength of the arcing gas flow 13 and therefore of the energy flow into the heating volume 7 can be determined by the energy of the arc 8. For example, the pressure of the arcing gas in the arc zone 9 increases with the square of the current maximum of the half-cycle of the current to be interrupted. At very high short-circuit currents, the pressure in the insulating nozzle 6 can become very high and can then lead to damage to the insulating nozzle 6. In addition, very hot arcing gas flows into the heating volume 7, which can substantially reduce the quality of the quenching gas 14 stored there.

In order to upwardly limit the pressure of the arcing gas 13 in the arc zone 9 and therefore, at the same time, the pressure and the temperature of the quenching gas 14 in the heating volume 7, the breaker, according to an exemplary embodiment of the present disclosure, has a relief duct 20 which opens out into the expansion space 15, and an overpressure valve 30, with which the pressure of the arcing gas 13 and therefore the pressure of the quenching gas 14 is limited above a specific value of the pressure of the arcing gas 13 in the arc zone 9 and of the quenching gas 14 in the heating volume 7, respectively, by the relief duct 20 being opened.

In all embodiments, the pressure relief takes place from the arc zone 9 and/or the heating volume 7 through an outflow section 21, which extends in the radial direction, of the relief duct 20. Since the pressure of the arcing gases 13 in the arc space 9 is thus kept below a pressure limit value, the insulating nozzle 6, whose length is to be dimensioned in the axial direction proportionally with respect to the maximum effective pressure, can advantageously have a short physical length. In addition, the insulating nozzle 6 and the heating volume 7 are thus protected from excessive thermal and mechanical loading by virtue of the hot arcing gas 13. In addition, a quenching gas 14 of good quality is thus achieved in the heating volume 7, since excessively hot and highly compressed arcing gas 13 is largely kept away from the heating volume 7 by virtue of the limitation of the pressure of the arcing gas 13 in the arc zone 9 above a limit value for the gas pressure. Below the pressure limit value, an axially aligned flow of hot arcing gas 13 can then continue to enter the heating volume 7, where the flow of hot arcing gas 13 can mix with cool insulating gas already present there to form the quenching gas 14. When the pressure limit value is reached or exceeded, the hot arcing gas 13 which enters axially into the heating volume 7 is removed radially from the heating volume 7. A circulation of the quenching gas 14 in the heating volume 7, which circulation is brought about by the hot arcing gas 13 which flows in axially below the pressure limit value, then ceases to take effect. The temperature of the quenching gas 14 provided in the heating volume 7 therefore remains low, with the result that its good quality is maintained even in the event of an occurrence of particularly powerful switching arcs 8.

Figure 2:
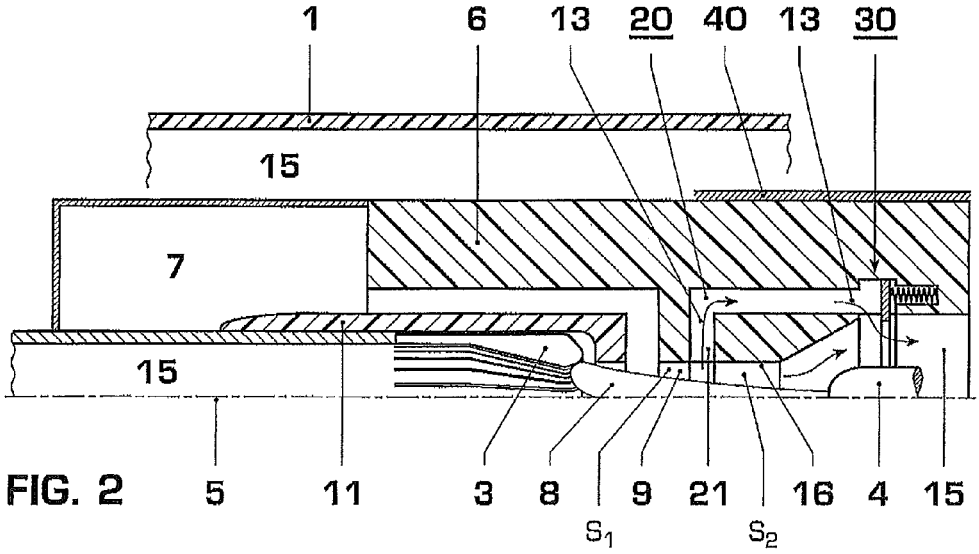
Figure 3:
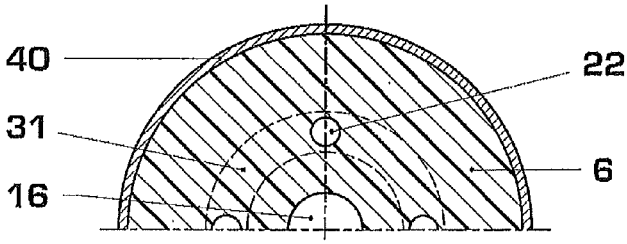

In accordance with the exemplary embodiment of the breaker shown in FIGS. 1 to 3, the pressure relief taking place in a radial direction is achieved by virtue of the fact that the outflow section 21 branches off from the cylindrical and axially extended constriction 16 of the insulating nozzle 6. It is apparent that a section 22, which is guided axially in the insulating nozzle 6, of the relief duct 20, which is sealed below the pressure limit value of the arcing gas 13 by the overpressure valve 30, adjoins the outflow section 21. The overpressure valve 30 has a valve body 31, which is in the form of an annular disk, is loaded by a prestressed restoring spring 32, and is mounted movably, counter to the force of the spring 32, in a cutout in the insulating nozzle 6. According to the exemplary embodiment illustrated in FIGS. 1 and 3, the cutout is aligned axially and adjoining the duct section 22.

When interrupting low currents (for example, at most approximately 5 to approximately 15% of the maximum permissible short-circuit interruption current) or medium currents (for example, at least approximately 5 to approximately 15% and approximately 30 to approximately 60% of the maximum permissible short-circuit interruption current), the pressure of the arcing gas 13 which is produced predominantly by heating of the insulating gas and release of gases from the material of the insulating nozzle 6, is not sufficient for opening the overpressure valve 30. As shown in FIG. 1, some of the arcing gas 13 is guided through the heating channel into the heating volume 7 and mixes there with cool insulating gas so as to form compressed quenching gas 14. If the current to be interrupted approaches a zero crossing, the quenching gas 14 flows out of the heating volume 7 via the heating channel 10 into the arc zone 9 and blows the switching arc 8 beyond the zero crossing until the current has been definitively interrupted.

When interrupting a high current (for example, at least approximately 30 to approximately 60% of the maximum permissible short-circuit interruption current), the pressure of the arcing gas 13 in the arc zone 9 can become so great (for example, the pressure values may be from 30 to 150 bar) that the overpressure valve 30 opens and some of the hot arcing gas 13 is removed radially from the arc zone 9 and flows via the relief duct 20 and the open overpressure valve 30 into the expansion space 15 (see, e.g., FIG. 2). Since the switching arc 8 extends over the entire length of the nozzle constriction 16, two stagnation points $S_1$ and $S_2$ (which extend annularly about the axis 5) in the arcing gas flow 13 are formed to the right and left of the outflow cross section 21 in the nozzle constriction. As a result, the arcing gas flow 13 escapes with a partial flow positioned between the two stagnation points $S_1$ and $S_2$ through the outflow section 21 of the open relief duct 20 into the expansion space 15. By virtue of the formation of the two stagnation points $S_1$ and $S_2$, the gas pressure in the insulating nozzle 6 is reduced virtually without any delay and thus the insulating nozzle 6 and correspondingly the heating volume 7 are protected very rapidly from impermissibly high mechanical and thermal loads by virtue of the hot arcing gas 13. In order to achieve a reduction in the gas pressure which is generally sufficient, the flow cross section of the outflow section 21 is equal to or greater than the flow cross section of the constriction 16. By arranging the outflow section 21 in the center of the constriction 16, a particularly great reduction in the gas pressure in the arc zone 9 of up to 50% can be achieved.

Hot arcing gas 13 which is still present in the relief duct 20 or in other cavities in the insulating nozzle 6 or metallic component parts used in the overpressure valve can, if necessary, reduce the dielectric strength of the insulating nozzle 6. The insulating nozzle 6 therefore bears an electrically conductive shield 40 on an axially extended section of the outer side of the insulating nozzle 6. According to an exemplary embodiment, the conductive shield 40 homogenizes the electrical field in the insulating nozzle 6 which is effective during a switching operation and shielding the radial component thereof.

As illustrated in FIG. 3, the relief duct has a plurality of (e.g., four) axially extended duct sections 22 which are arranged so as to be distributed substantially uniformly in the circumferential direction about the axis 5. This results in a flow cross section of the relief duct 20 which is dimensioned suitably for sufficiently high pressure reduction and a high mechanical strength of the insulating nozzle 6. As illustrated in FIG. 3, the valve body 31 can be in the form of a flat ring, in a manner which is favorable in terms of manufacture.

Figure 4:
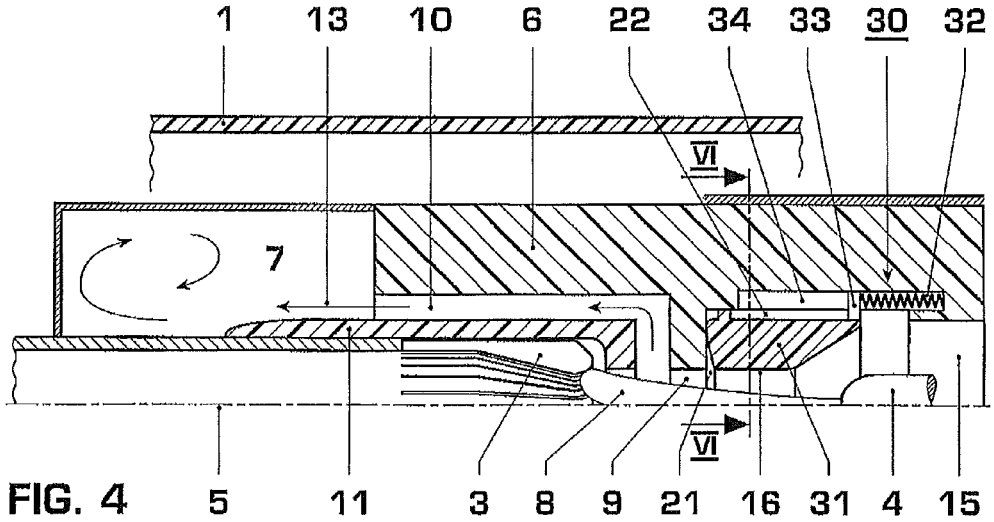
Figure 5:
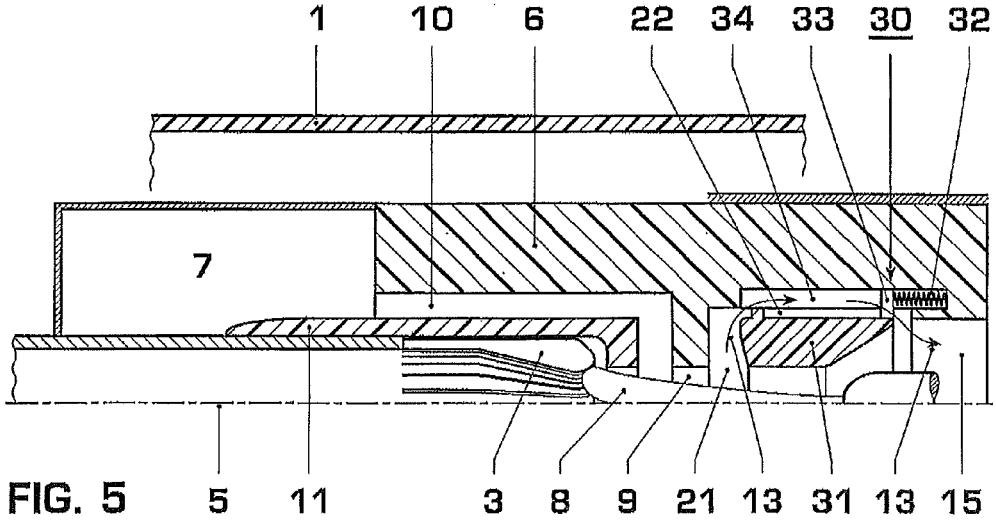
Figure 6:
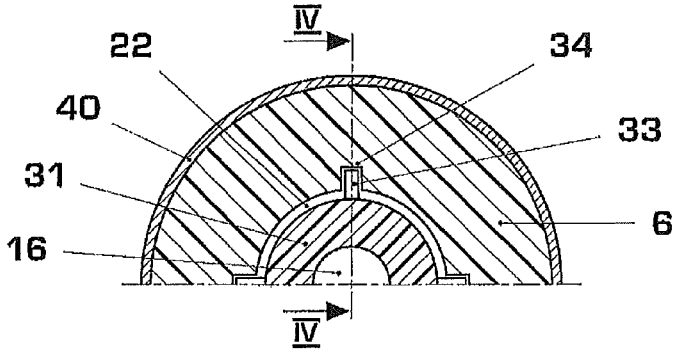

In the exemplary embodiment of the breaker shown in FIGS. 4 to 6, the radial pressure relief likewise takes place in the constriction 16 of the insulating nozzle 6. However, the outflow section 21 no longer has a constant flow cross section, but is variable as a function of the pressure of the arcing gas formed in the arc zone 9 above a limit value of the pressure of the arcing gas 13. As can be seen from FIGS. 4 to 6, the outflow section 21 now belongs to the overpressure valve 30 and is therefore integrated in the insulating nozzle 6 as well as the overpressure valve 30. The valve body 31 is formed by an annular part of the insulating nozzle 6, where the annular part can surround the constriction 16 of the nozzle 6. A plurality of (e.g., four) radially outwardly extended sliding bodies 33 are fitted on the valve body 31 and are each mounted in one of a plurality of (e.g., four) axially extended guide channels 34, which are arranged so as to be offset substantially uniformly with respect to one another in the circumferential direction, and a restoring force is applied to the sliding bodies via a plurality of springs 32.

The springs 32 are set in such a way that, above a predetermined value of the pressure of the arcing gas 13, the valve body 31, which is subjected to the pressure of the arcing gas 13, is moved towards the right (in the views of the exemplary embodiments illustrated in the drawings) so as to form the radial outflow section 21, and releases the guide channels 34. As illustrated in FIG. 5, the arcing gas 13 can then flow out via the outflow section 21, the guide channels 34 and the duct section 22 into the expansion space 15.

Figure 7:
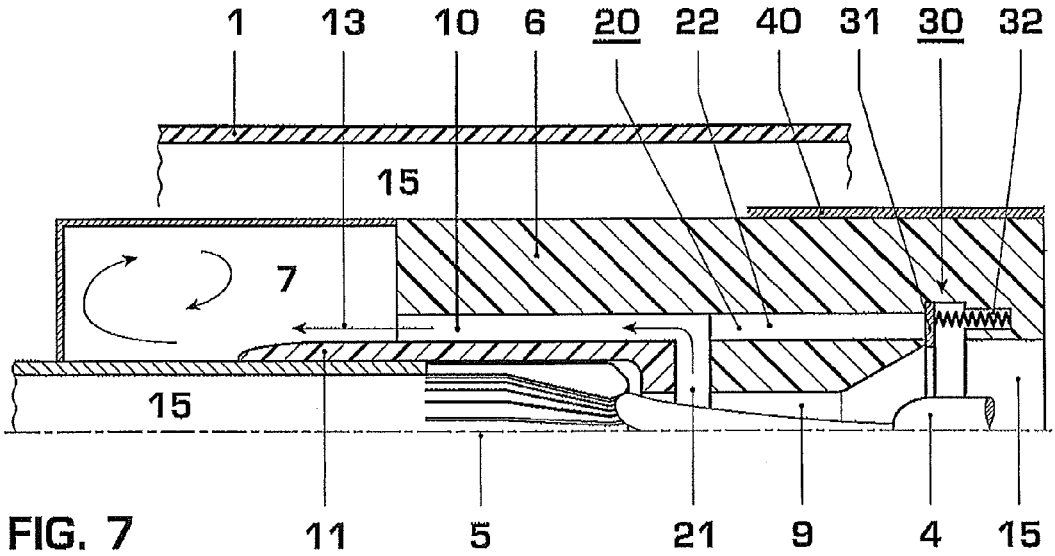
Figure 8:
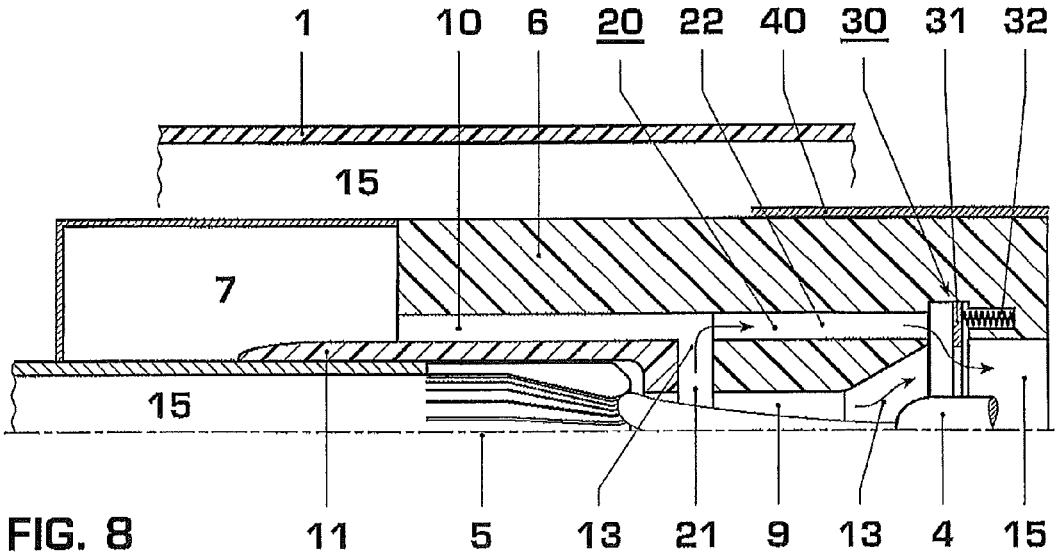

In the exemplary embodiment of the breaker shown in FIGS. 7 and 8, the outflow section 21 forms a circular mouth section of the heating channel 10, which mouth section 21 merges with the arc zone 13. The outflow section 21 has a constant flow cross section and can be connected to the expansion space 15 via the axially extended section 22 or a plurality of axially extended sections 22 of the relief duct 20 and the overpressure valve 30. When the overpressure valve 30 responds (see FIG. 8), the hot arcing gas 13 also flows away via the mouth section 21 of the heating channel 7, the at least one axially extended section 22 and the now open overpressure valve 30 into the expansion space 15. In this embodiment, the pressure of the arcing gas 13 in the arc zone 9 is not reduced to such an extent as in the previously described embodiments, but this embodiment is easy to manufacture and makes it possible for all of the arcing gas 13 formed between the stagnation point of the auxiliary insulating nozzle 11 and the stagnation point of the insulating nozzle 6 to be transported through the relief duct 20 if the pressure of the quenching gas in the heating volume 7 is higher than the pressure of the arcing gas 13 in the arc space 9.

Figure 9:
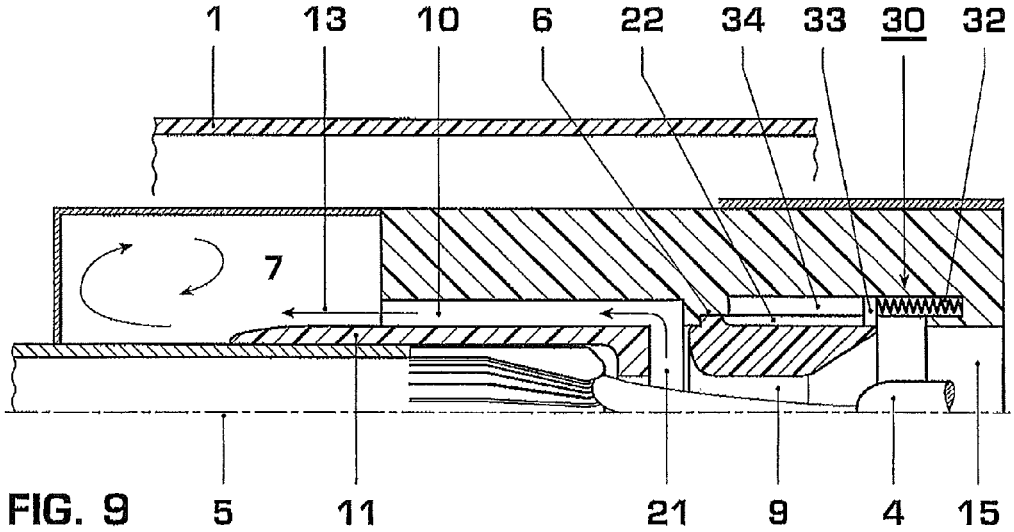

In the exemplary embodiment of the breaker shown in FIG. 9 as well, the outflow section 21 forms the mouth section of the heating channel 10 which merges with the arc zone 13, but the outflow section 21 now has a flow cross section which varies as a function of the arcing gas pressure above a limit value of the pressure of the arcing gas 13. In accordance with the exemplary embodiment of the breaker shown in FIGS. 4 to 6, the outflow section 21 is now part of the overpressure valve 30 and is therefore integrated in the insulating nozzle 6 along with the overpressure valve 30.

In the three exemplary embodiments of the breaker shown in FIGS. 10 to 13, the outflow section 21 contains an opening, which is formed into a tubular contact carrier of the arcing contact 3, which is rigidly connected to the insulating nozzle 6. The opening is sealed by a movable valve body 31 of the overpressure valve 30. The valve body 31 responds to a pressure difference, below a limit value of the pressure of the quenching gas 14.

Figure 10:
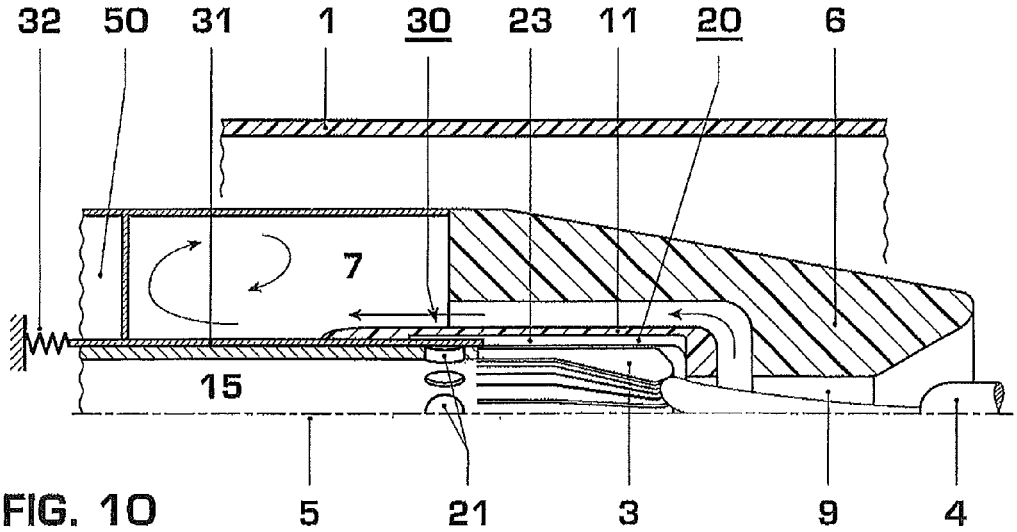

In the exemplary embodiment shown in FIG. 10, the relief duct 20 is guided from the arc zone 9 through an axially extended section 23, which is delimited by the auxiliary nozzle 11 and the arcing contact 3, of the relief duct 20 and the outflow section 21, which is in the form of an opening in the contact carrier, into the expansion space 15. The valve body 31 is in the form of an axially aligned sleeve, and it is possible for the pressure difference between the duct section 23 and a piston/cylinder compression space 50 for producing a small additional quantity of quenching gas to be applied to the valve body 31. A sufficiently high pressure difference is also present at the sleeve or the valve body 31 when the sleeve 31 is guided through the space 50 into the expansion space 15 or merely into the heating volume 7.

Figure 11:
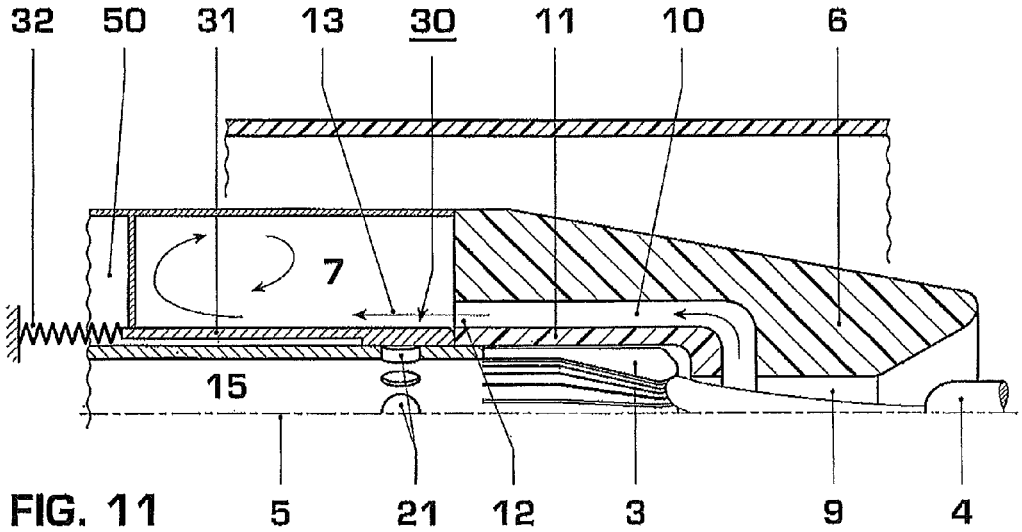
Figure 12:
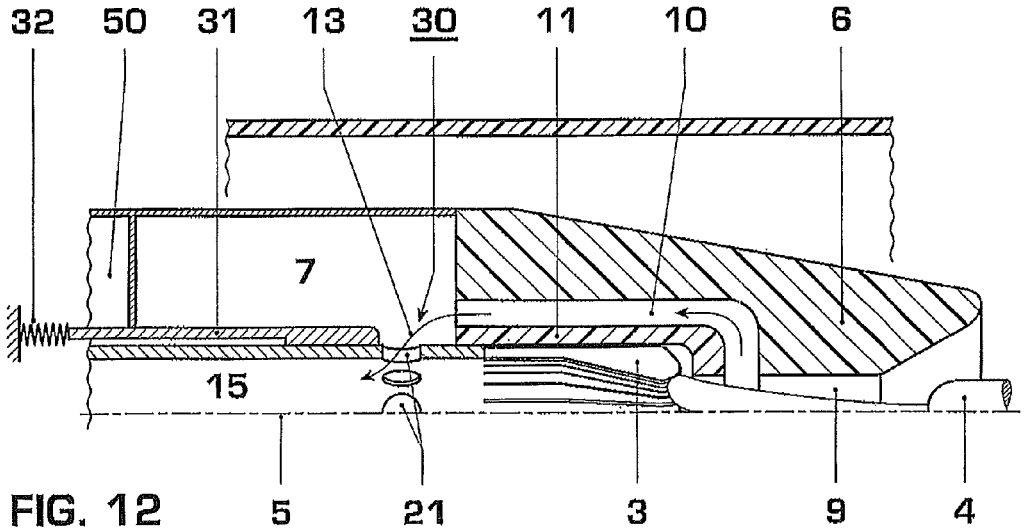

In the exemplary embodiment shown in FIGS. 11 and 12, the opening 21 is arranged at the mouth 12 of the heating channel 10 into the heating volume 7. When the overpressure valve 30 is open (see FIG. 12), the heating volume 7 is then connected to the expansion space 15. A jet of hot arcing gas 13, which emerges predominantly axially from the heating channel 10, is then deflected, when the valve 30 is open, at the opening 21, and is guided in the radial direction through the opening 21, which acts as a radial outflow section 21 of the relief duct 20, into that part of the expansion space 15 which is delimited radially by the tubular contact carrier of the arcing contact 3. Radial outflow therefore results in, firstly, a hot arcing gas flow 13 largely being kept away from the interior of the heating volume 7 and the quality of the quenching gas present there being kept high, and secondly, the pressure in the arc zone 9 being limited above a predetermined limit value of the pressure of the quenching gas 14.

According to an exemplary embodiment, the valve body 31 is in the form of an axially aligned sleeve. It is therefore readily possible, as illustrated, for a plurality of openings to be provided in the contact carrier of the arcing contact 3, which openings form the outflow section 21 and ensure uniform outflow of the arcing gases 13. The pressure difference causing the overpressure valve 30 to open is clearly effective between the heating volume 7 and the piston/cylinder compression space 50, into which the sleeve 21 is guided in a gas-tight manner. A comparable control effect of the sleeve 21 is also achieved if the sleeve 21 is guided from the heating volume 7 through the piston/cylinder compression space 50 into the expansion space, or if the sleeve 21 is guided from the heating channel 10 merely into the heating volume 7 or through the heating volume into the compression space 50 and possibly through the compression space 50 into the expansion space 15.

Figure 13:
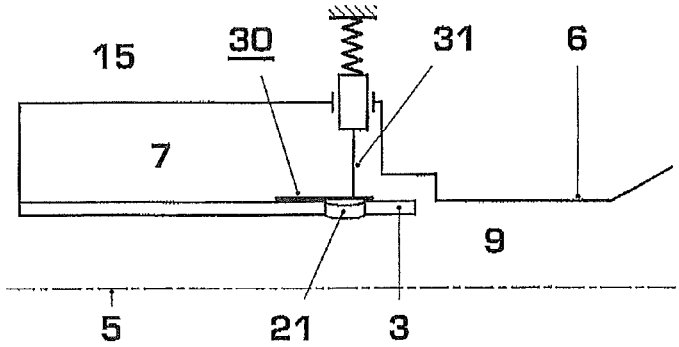

Alternatively, the valve body 31 can also be in the form of a radially movable part, as illustrated in FIG. 13, for example. The pressure difference between the heating volume 7 and the expansion space 15 acts on the valve body 31 in this exemplary embodiment of the breaker according to the present disclosure. Given a corresponding arrangement of the valve body 31, the pressure difference between the arc zone 9 and the expansion space 15, or between the heating volume 7 and the expansion space 15, can also radially load the valve body 31. In contrast to the exemplary embodiment shown in FIGS. 11 and 12, a part of the overpressure valve 30 which is to be driven separately, is arranged for each opening 21 in the contact carrier of the arcing contact 3 in the form of a movable valve body 31.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

1 Quenching chamber housing
2 Contact arrangement
3, 4 Arcing contacts
5 Axis
6 Insulating nozzle
7 Heating volume
8 Switching arc
9 Arc zone
10 Heating channel
11 Auxiliary insulating nozzle
12 Mouth opening
13 Arcing gas
14 Quenching gas
15 Expansion space
16 Constriction
20 Relief duct
21 Outflow section
22, 23 Duct sections
30 Overpressure valve
31 Valve body
32 Compression spring
33 Sliding body
34 Guide channel
40 Shield
50 Compression space

What is claimed is:

1. A gas-insulated high-voltage circuit breaker comprising:

two arcing contacts, which are configured to move relative to one another along an axis;

an insulating nozzle;

a switching arc configured to be formed when the breaker opens and generates an arcing gas;

a heating volume for accommodating a quenching gas, whose pressure is based on the energy of the switching arc formed when the breaker opens and generates the arcing gas;

an arc zone, which is delimited from the two arcing contacts axially and radially with respect to the insulating nozzle;

an expansion space, into which the quenching gas expands during disconnection of the breaker after blowing of the switching arc;

a relief duct which opens out into the expansion space;

a heating channel, which connects the arc zone to the heating volume and opens out, with axial alignment, into the heating volume, and which connects the expansion space, to the relief duct; and an overpressure valve configured to limit the pressure of the quenching gas by opening the relief duct, wherein the relief duct has an outflow section which extends in the radial direction.

2. The breaker as claimed in claim 1, wherein the outflow section branches off from a cylindrical and axially extended constriction of the insulating nozzle.

3. The breaker as claimed in claim 2, wherein a flow cross section of the outflow section is equal to or greater than a flow cross section of the constriction.

4. The breaker as claimed in claim 2, wherein the outflow section is arranged approximately centrally in the constriction.

5. The breaker as claimed in claim 1, wherein the outflow section is part of the heating channel.

6. The breaker as claimed in claim 2, wherein at least one axially extended section of the relief duct adjoins the outflow section, and an annular valve body of the overpressure valve is mounted moveably in the at least one axially extended section of the relief duct.

7. The breaker as claimed in claim 6, wherein the outflow section is variable as a function of a pressure of the arcing gas formed in the arc zone above a limit value of a pressure of the arcing gas.

8. The breaker as claimed in claim 7, wherein the valve body is part of the insulating nozzle and is formed by an axially extended section of the nozzle constriction.

9. The breaker as claimed in claim 7, wherein the valve body is part of the insulating nozzle and forms the nozzle constriction.

10. The breaker as claimed in claim 8, wherein at least two radially outwardly extended sliding bodies are fitted on the valve body, said sliding bodies being respectively mounted in one of two axially aligned guide channels, which are arranged so as to be offset with respect to one another in the circumferential direction, and a restoring force being applied to said sliding bodies.

11. The breaker as claimed in claim 6, wherein the outflow section has a constant flow cross section.

12. The breaker as claimed in claim 6, wherein the relief duct has a plurality of axially extended duct sections, which are arranged so as to be distributed substantially uniformly in a circumferential direction about the axis.

13. The breaker as claimed in claim 1, wherein the insulating nozzle bears an electrically conductive shield.

14. The breaker as claimed in claim 1, wherein the outflow section contains an opening, which is formed into a tubular contact carrier of an arcing contact, which is rigidly connected to the insulating nozzle, and is sealed by a movable valve body of the overpressure valve, said valve body responding to a pressure difference, below a limit value of a pressure of the quenching gas.

15. The breaker as claimed in claim 14, wherein the opening is arranged at a mouth of the heating channel into the heating volume, and, when the overpressure valve is open, is configured to connect the heating volume to the expansion space.

16. The breaker as claimed in claim 15, wherein the valve body is in the form of an axially aligned sleeve, to enable application of a pressure difference between at least one of (i) the heating channel and the heating volume (ii) the heating volume and the expansion space, and (iii) a compression space to said valve body.

17. The breaker as claimed in claim 15, wherein the valve body is in the form of a radially movable part, to enable application of a pressure difference between at least one of (i) the arc zone and the heating volume, (ii) the heating volume and the expansion space, and (iii) the arc zone and the expansion space to said valve body.

18. The breaker as claimed in claim 14, wherein the relief duct is configured to be guided from the arc zone through an axially extended section of the relief duct, said axially extended section being delimited by an auxiliary nozzle and the arcing contact, wherein the outflow section is in the form of an opening in the contact carrier into the expansion space, wherein the valve body is in the form of an axially aligned sleeve, to enable application of a pressure difference of at least one of (i) between the axially extended duct section of the relief duct and the heating volume, (ii) a compression space, and (iii) the expansion space to be applied to said valve body.

19. The breaker as claimed in claim 3, wherein the outflow section is arranged approximately centrally in the constriction.

20. The breaker as claimed in claim 5, wherein at least one axially extended section of the relief duct adjoins the outflow section, and an annular valve body of the overpressure valve is mounted moveably in the at least one axially extended section of the relief duct.

21. The breaker as claimed in claim 9, wherein at least two radially outwardly extended sliding bodies are fitted on the valve body, said sliding bodies being respectively mounted in one of two axially aligned guide channels, which are arranged so as to be offset with respect to one another in the circumferential direction, and a restoring force being applied to said sliding bodies.

22. The breaker as claimed in claim 10, wherein the relief duct has a plurality of axially extended duct sections, which are arranged so as to be distributed substantially uniformly in a circumferential direction about the axis.

* * * * *